United States Patent [19]

Bendell

[11] 4,231,127

[45] Nov. 4, 1980

[54] FOLDABLE CUSHIONING AND SUPPORT

[76] Inventor: Abraham D. Bendell, 1 Kirkstone Ave., Cullercoats, Whitley Bay, Tyne and Wear, England

[21] Appl. No.: 934,473

[22] Filed: Aug. 17, 1978

[51] Int. Cl.[2] ..... A47C 23/00

[52] U.S. Cl. ..... 5/462; 5/465; 5/474

[58] Field of Search ..... 5/352, 357, 66, 465, 5/464, 462, 448, 485, 474; 112/262

[56] References Cited

U.S. PATENT DOCUMENTS

| | | | |
|---|---|---|---|
| 1,549,289 | 8/1925 | Bradley | 5/352 |
| 1,785,252 | 12/1930 | Frank | 5/357 |
| 3,188,660 | 6/1965 | Guttman | 5/352 |
| 4,133,063 | 1/1979 | Jones Steele | 5/352 |

*Primary Examiner*—Roy D. Frazier
*Assistant Examiner*—Alexander Grosz
*Attorney, Agent, or Firm*—Steinberg and Blake

[57] ABSTRACT

At least a pair of separate cushioning members are interconnected by an overlying face of a cover and disposed side by side at the side regions, border strips are secured each along one of their edges to a corresponding inner skin overlying one main face of a cushioning member, at the opposite main faces corresponding cover sheets are secured at the other edges of the border strips; the interconnecting cover overlies the inner skins and is secured along its periphery to them and to the first-mentioned edges of the border strips.

The method includes joining two border strips each to one edge of an inner skin, drawing them round a cushioning member and securing a cover sheet to each, over laying an additional cover sheet over both skins and securing it peripherally to them and the adjacent edges of the border strips forming two pouches one to both sides of a hingeable fold zone of the overlying cover sheet.

A matress is provided, foldable for transport on stairways and access to a support with a corresponding hingeable base board.

9 Claims, 5 Drawing Figures

FOLDABLE CUSHIONING AND SUPPORT

This invention relates to improvements in and in connection with mattresses and the like cushioning.

The handling, transport and storage of folded cushioning are difficult operations. The folding operation itself can crush the resilient interior with the consequent risk that it may be permanently distorted; a risk realised sooner rather than later in coiled springing and double bed mattresses. Such distortion can result in yielding of support and, in cases where springs are broken or dismounted, spiking of the user thereby through the cushioning cover.

An object of the invention is to provide cushioning, for example for facilitating the turning of a mattress, for a double bed which is foldable without distortion of the resilient interior and undue resistance.

According to one embodiment of the invention the cushioning comprises a pair of separate cushioning members disposed side by side their respective side regions being covered by border strips. The border strips are each secured along one of their edges to a respective inner skin, each inner skin being defined by a cover sheet, overlying one main face of a respective cushioning member the main faces of the respective cushioning members which are opposite to the main faces first referred to are covered by corresponding cover sheets secured to the respective other edges of the border strips A further cover sheet overlies the inner skins, secured along its periphery to them and to the peripheral portions of the first-mentioned edges of the border strips and each inner skin forming a pouch with the further cover sheet. A band of the cover sheet constituted a hingeable fold zone overlying the first-mentioned edges of the juxtaposed border strips.

The invention according to another aspect consists of a method of making cushioning as hereinbefore described comprising joining two border strips each along part of one edge to a respective sheet for forming an inner skin, drawing one of the border strips around a cushioning member overlain by one of the skins and securing a cover sheet peripherally to the skin and border strip, along portions of said edge which have not already been secured to the skin, drawing the border strip around another cushioning member overlain by the other skin and securing said cover sheet peripherally to the said other skin and other border strip, along portion said edge of the latter which have not already been secured to its skin, laying an additional cover sheet over the uncovered face of one of the cushioning members and securing it peripherally to the other edge of the border strip therearound and laying a further cover sheet over the uncovered face of the other cushioning member and securing it peripherally to the other edge of the border strip therearound.

A mattress according to the invention may with advantage be provided with a bed frame in accordance with British Patent No. 1,399,911 alternatively or additionally with a dismantleable divan.

The invention will be further described by way of example with reference to the accompanying drawing in which.

Figure 1:
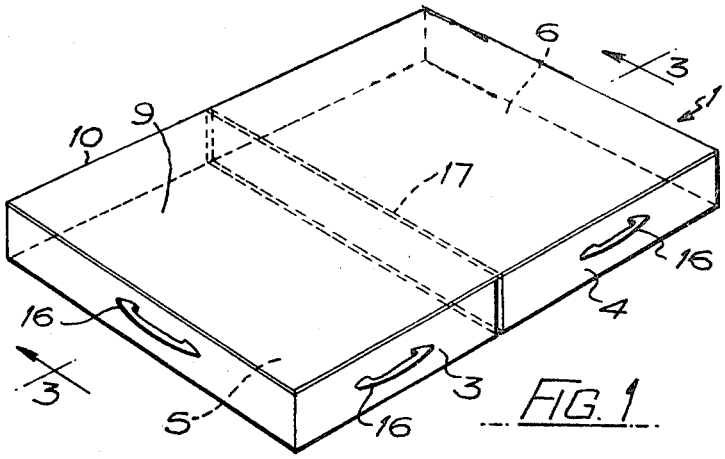
FIG. 1 shows a mattress having two cushioning members cojoined in accordance with the invention.
Figure 2:
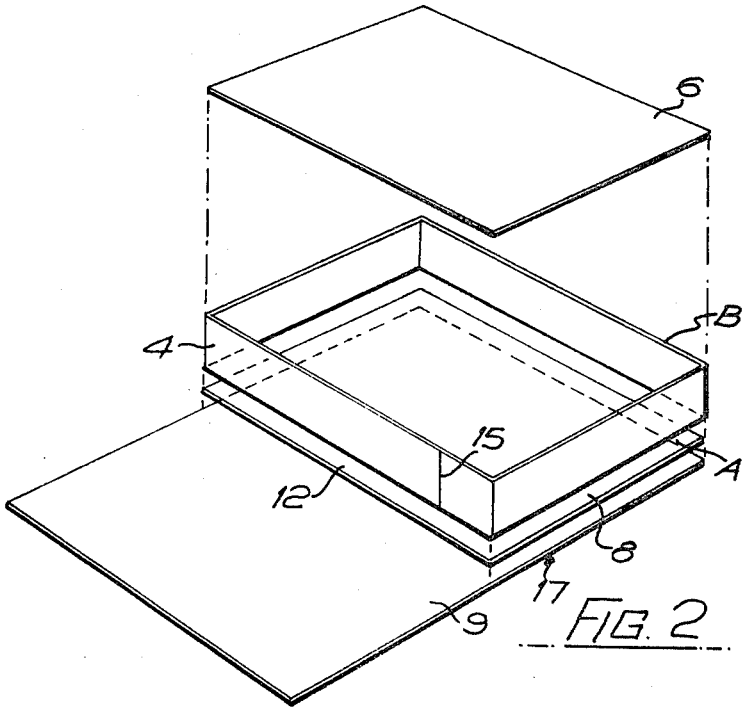
FIG. 2 is inverted with respect to FIGS. 1,3,4 and 5 and illustrates the arrangement of sheet material employed in a mattress or the like cushioning member according to the invention.
Figure 3:
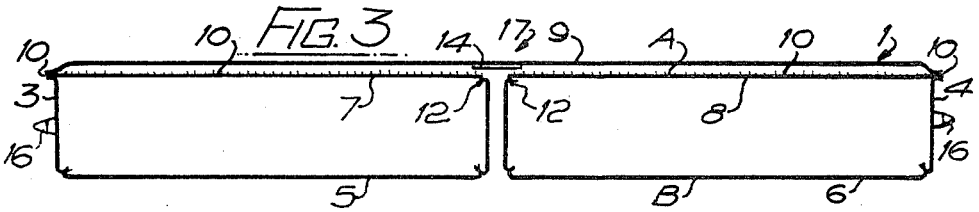
FIG. 3 is a section in elevation on line 3—3 of FIG. 1.

The mattresses 1, 2 comprise a pair of border strips 3, 4 (FIGS. 1–3) and $3^1$, $4^1$ (FIGS. 4 and 5), each being secured along one i.e., a first edge B, $B^1$ as seen in the drawings to a corresponding cover sheet 5, 6 and $5^1$, $6^1$ and respectively at adjacent sides of the other, i.e., a second edge A, $A^1$ to inner sheets 7, 8. A further cover sheet 9, $9^1$ overlying the latter inner sheets 7, 8 is secured along its periphery to the inner sheets and to the other sides of said other edges A, $A^1$ of the border strips along a U-shaped seam 10, (FIG. 2) the arms of the U extending to a position upwardly spaced from the end of the corresponding end of the cushioning member so that pouches are formed between the cover sheet 9, $9^1$ and the inner sheets 7, 8.

In manufacture of the mattress of the present invention, the two border strips 3, 4 and $3^1$, $4^1$ are joined each along part 12 which may comprise one side of the one edge A, $A^1$ to a respective sheet 7, 8, the sheets each thereby forming an inner skin. The method includes the steps wherein the border strip 4, $4^1$ is drawn around a cushioning member overlain by the skin 8 and a cover sheet 9, $9^1$ is secured peripherally to the skin and border strips 4, $4^1$, along said edge A, $A^1$ where not already secured at 12 to the skin 8, and the similar steps of drawing the other border strip 3, $3^1$around another cushioning member overlain by the skin 7 of the other border strip and securing the cover sheet 9, $9^1$ peripherally to the skin 7 and border strip 3, $3^1$ along the U-shaped edge of the latter where not already secured to its skin 8, at 12. An additional cover sheet 6, $6^1$ over the uncovered face of one of the cushioning members and is secured along its periphery to the other edge B of the border strip 4, $4^1$ therearound. A further cover sheet 5, $5^1$ is layed over the uncovered face of the other cushioning member and is secured along its periphery to the other edge of the border strip 3, $3^1$ therearound.

The above-described procedure results in the covered cushioning of the invention which is seen as being foldable in a zone extending across the larger cover sheet 9, $9^1$ between the separate cushioning members, which zone may extend transversely (FIGS. 1 to 3) and/or longitudinally (as in FIGS. 4 and 5) with respect to the long dimension of the cushioning which may comprise a mattress. The skins 7, 8 which may be of plain material form pouches beneath the respective parts of the larger cover sheet 9, $9^1$ which is usually of upholstery or other decorative fabric and may be, as illustrated free of stitching or quilting over its entire face.

The foldable zone extends, in the form of a band of material of the cover sheet 9, $9^1$, with a width corresponding to the distance, at each of its ends, between the adjacent ends of the seam 10.

The preliminary partial attachment of the skins 7, 8 to the border strips may be effected by seaming at part 12 on a conventional sewing machine and attachment of the cover sheets is preferably made secure on a tape edge sewing machine, preferably of the kind which is adjustable in height above a table for stitching the final smaller cover sheets 5, 6 when the larger cover sheet 9, 9[1] is folded so that the cushioning members are positioned one on top of another.

A tape 13 is incorporated in the stitching around the peripheries of the sheets 5–9 and further support, possibly in the form of a wire which may be a flexible spiral wound plastic covered wire, is incorporated e.g. along the transverse and/or longitudinal stitching of the border strips to the smaller cover sheets 5, 6 and 5[1] and 6[1] thereby affording protection where the cushion or mattress may most be used e.g. centrally. If desired, such further support may be provided along the partial attachments at part 12 of the inner skins 7 and 8 to the border strip and/or around the outer peripheries of the cover sheets at 10. A further strip 14 (FIG. 3) may be applied beneath the fold line of the larger cover sheet 9 between the cushioning members.

In assembling the parts of a mattress or like cushion the border strips 3, 4 and 3[1], 4[1] are joined at 15 by a ring or the like as in normal practice and after partial attachment at part 12 of the inner sheet skins 7 and 8, it is much preferred to attach the cover sheets 9, 9[1] over the skins prior to attachement of the cover sheets 5, 6 and 5[1], 6[1] over the other faces of the mattress spring assemblies which are omitted from the drawings for clarity, the border strips being drawn up to the skins and the latter smoothed over the underlying spring assembly covering, or other cushioning, with the border strips temporarily stapled or pinned in place before adding the cover sheet and bringing round the edge stitcher in accordance with procedures familiar to the operatives.

Loop handles 16 are provided at the sides of the mattresses 1,2 and/or at the sides of each cushioning member remote from the fold line(s) indicated at 17 for facilitating turning of the mattress, affording access to a centrally hinged mattress support when used with a bed frame as described and claimed in British Pat. No. 1,399,911 or any other divan having a divided mattress support with storage space.

Figure 4:
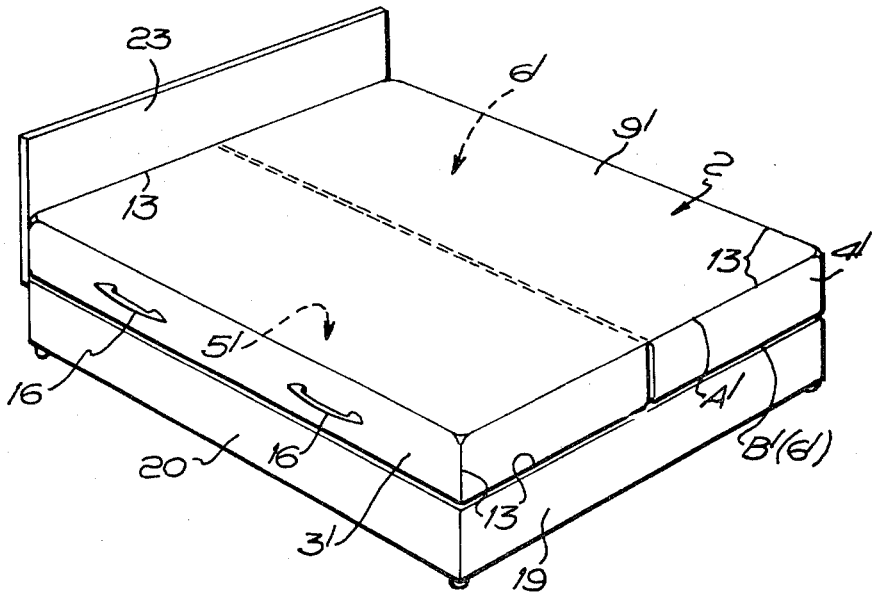
FIG. 4 shows a mattress, as shown in FIG. 1 except that it is cojoined lengthwise rather than breadthwise, on a divan base
Figure 5:
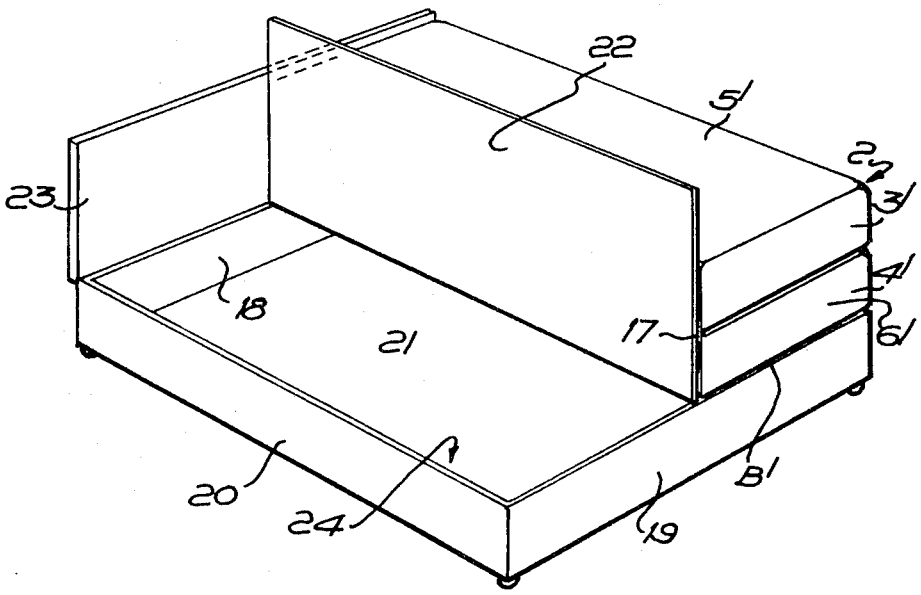
FIG. 5 shows the divan of FIG. 4 with the mattress folded and a divided base board lifted to afford access to storage space.

The divan of FIGS. 4 and 5 has head, foot and two side members 18 19, 20 with a lower sheet of hardboard 21, a divided plywood base board 22 and head board 23. Storage space is provided at 24 access to which is obtained simply by raising one cushioning member over onto the other and lifting the board 22.

The divan may be dismantleable and have corner connectors detachably for locating the side and end members in rectangular form, one or more cross-bracers for connecting receptors at the lower edge regions of the side members and a bridge piece may be extended beneath and along a hinge-line, where provided with the divided base board 22. Cover connectors may have three webs in initially perpendicular places forming a socket, two of the webs having notches slots therein for engaging protrusions on the side and end members.

What I claim is:

1. Foldable cushioning comprising:

a pair of separate cushioning members, each cushioning member having opposed faces and peripheral side regions extending between said opposed faces, said cushioning members being disposed side by side with respective portions of said side regions being disposed adjacent to and extending substantially parallel to each other;

a pair of border strips, each border strip extending around and over a respective cushioning member side region and having first and second edges;

a pair of inner skins, each inner skin overlying one face of a respective cushioning member and being secured to the second edge of a respective border strip;

a pair of cover sheets, each cover sheet overlying the other face of a respective cushioning member and being secured to the first edge of a respective border strip; and a further largest cover sheet overlying both of said inner skins, said further cover sheet having a peripheral edge which is secured to at least a portion of the second edges of the respective border strips in a manner such that a pouch is defined between said further cover sheet and each of said inner skins and such that the portion of said further cover sheet extending between the adjacent portions of the side regions of said cushioning members comprises a band-like portion constituting a hinge-like fold zone.

2. Cushioning as claimed in claim 1 in which the further, largest, cover sheet is free of stitching over its face.

3. Cushioning as claimed in claim 1 in which a tape is incorporated in the stitching around the peripheries of the inner skins.

4. Cushioning as claimed in claim 1 wherein a support wire is incorporated along transverse stitching of the border strips to the cover sheets affording protection where the cushion or mattress is most used.

5. Cushioning as claimed in claim 1 in which a support wire is incorporated along an attachment of the juxtaposed border strips at their second edges to the inner strips.

6. Cushioning as claimed in claim 1 having a supporting strip of material applied beneath a fold line of the larger cover sheet between the cushioning members.

7. Cushioning as claimed in claim 1 in which a tape is incorporated in the stitching around the peripheries of the cover sheets.

8. Cushioning as claimed in claim 1 wherein a support wire is incorporated along longitudinal stitching of the border strips to the cover sheets affording protection where the cushion or mattress is most used.

9. Cushioning as claimed in claim 1 in which a support wire is incorporated along an attachment of the juxtaposed border strips at their second edges around the outer periphery of the further sheet where the border strips are partially attached thereto.

* * * * *